United States Patent [19]

Goodrich et al.

[11] Patent Number: 5,048,160

[45] Date of Patent: Sep. 17, 1991

[54] BUTTON REPLACEMENT DEVICE

[76] Inventors: Lewis S. Goodrich; Wanda L. Goodrich, both of P.O. Box 598, Driggs, Id. 83422

[21] Appl. No.: 506,099

[22] Filed: Apr. 9, 1990

[51] Int. Cl.[5] ..... A44B 18/00

[52] U.S. Cl. ..... 24/306; 24/90 HA

[58] Field of Search ..... 24/306, 442, 443, 444, 24/447, 448, 451, 90 HA; 2/DIG. 6

[56] References Cited

U.S. PATENT DOCUMENTS

| | | | |
|---|---|---|---|
| 2,524,842 | 10/1950 | Slamon et al. | 24/90 HA |
| 2,569,398 | 9/1951 | Burd et al. | 24/90 HA |
| 3,142,088 | 7/1964 | Cravath | 24/90 HA |
| 3,405,408 | 10/1968 | Baker | 24/306 |
| 3,658,107 | 4/1972 | Perina | 24/306 |
| 3,895,797 | 7/1975 | Moore | 2/DIG. 6 |
| 4,554,710 | 11/1985 | Grant | 24/49 CF |
| 4,648,137 | 3/1987 | Cooper | 2/DIG. 6 |

FOREIGN PATENT DOCUMENTS

| | | | |
|---|---|---|---|
| 878809 | 10/1961 | United Kingdom | 2/DIG. 6 |
| 1161406 | 8/1969 | United Kingdom | 24/306 |

*Primary Examiner*—Victor N. Sakran

[57] ABSTRACT

A device for converting a button/button hole attachment combination in a shirt, blouse or the like to a pressure contact system which avoids the need of manipulating a small button through a small button hole. The device includes a first sheet of flexible material having an exposed side and attachment side, wherein the attachment side includes adhesive means for attachment to a button location on the shirt or blouse. A second sheet of flexible material including an exposed side and an attachment side includes a button coupled at its attachment side to facilitate positioning at a button hole corresponding to the button location means for the first sheet of material and located on the shirt or blouse. The respective exposed sides of the first and second sheets of material include hook/loop attachment means which are capable of being joined on contact and separated by merely pulling the respective pieces apart. Also disclosed is a method of use for the present invention.

6 Claims, 1 Drawing Sheet

BUTTON REPLACEMENT DEVICE

BACKGROUND OF THE INVENTION

1. Field of Invention

The present invention relates to devices for replacement of buttons commonly used to attach two pieces of fabric or other materials. More particularly, the present invention relates to devices which eliminate the need for manipulating a button through a button hole in order to fasten two pieces of fabric together, yet provide a "button" appearance consistent with a conventional button and button hole combination.

2. Prior Art

Perhaps the earliest form of attachment for clothing involved the use of a button sewed or otherwise attached to an edge of the fabric, which is oriented in alignment with a button hole positioned at an opposing fabric location. This button/button hole form of attachment has been applied to virtually every form of clothing, as well as many non-clothing items.

Several well known devices have partially replaced the traditional button/button hole combination as a fastening system. For example, the introduction of the zipper has provided a second major form of attachment. Although it offers some convenience advantages over buttons, it does not provide the secure means of attachment provided by the button/button hole combination.

A more recent innovation in convenient attachment devices comprises a variety of products using VELCRO (TM) or similar hook/loop combinations. Most applications for VELCRO have been as a substitute for zipper devices. Although other forms of attachment devices exist such as clasps, wire hooks, and miscellaneous related items, the button/button hole combination and zipper/VELCRO attachment means remain the dominant two methods for attaching fabrics in a closed configuration.

A significant problem has developed and existed over many years with respect to the button/button hole combination. There is a growing segment of the population which is encumbered with disabilities which make buttoning a shirt extremely difficult. Stroke victims and those who suffer arthritis are well acquainted with the painful effort required to manipulate a small button through a seemingly smaller button hole. In fact, many persons suffering from muscular and nervous disorders such as multiple sclerosis, muscular dystrophy, Alzheimers disease, cerebral palsy, Parkinson's syndrome, myasthenia gravis, etc., encounter great difficulty with such simple tasks as buttoning clothing. With the increasing longevity of life, these disabling problems are becoming of even greater significance.

OBJECTS AND SUMMARY OF THE INVENTION

It is therefore an object of the present invention to provide a device which modifies existing button/button hole configurations such that simple, contact attachment can occur while retaining the appearance of a conventional button configuration.

It is a further object of the present invention to provide a device which can be retrofitted to button clothing without significant expense or effort.

It is a still further object of this invention to facilitate attachment of clothing by means of a button/button hole configuration, yet which merely involves contacting faces of material for attachment.

These and other objects are realized in a device for converting a button/button hole attachment combination to a pressure contact system wherein the juxtaposed pieces of material to be temporarily joined together are adapted with a hook/loop or VELCRO (TM) material. The invention includes a first sheet of flexible material having an exposed side and an attachment side, with the attachment side including an attachment means for enabling permanent fixation on the first sheet of material. The second sheet of flexible material having an exposed side and attachment side also includes attachment means on its attachment side, enabling permanent fixation to a second sheet of material. The button is coupled to the attachment side of the second sheet of material. The respective exposed sides of the first and second sheets of material include hook/loop attachment means such as VELCRO (TM) which is capable of being joined on contact and separated by merely pulling the pieces apart.

Also disclosed is a method for converting a button/button attachment combination to a pressure contact attachment device, comprising the following steps. First, a first sheet of flexible material having an exposed side and an attachment side is positioned on the first piece of material to be joined at an overlapping position with the button location on the first piece of material. When properly positioned, this first sheet of material is permanently affixed at this overlapping position with attachment means. A second sheet of flexible material is positioned at the second piece of material to be joined in overlapping configuration with a button hole located thereat. A button attached to the attachment side of the second sheet is inserted through the button hole of the second piece of material to thereby secure its proper orientation. This second sheet is also fixed at this aligned position with attachment means. The device is now in place and ready for use, with the button inserted through the button hole of the second piece of material. Upon contacting the attached first and second sheets at the hook and loop sides of the VELCRO (TM) material, temporary attachment occurs while preserving a final, buttoned appearance.

Other objects and features of the present invention will be apparent to those skilled in the art, taken in view of the following detailed description, in combination with the accompanying drawings.

DETAILED DESCRIPTION OF THE INVENTION

Figure 1:
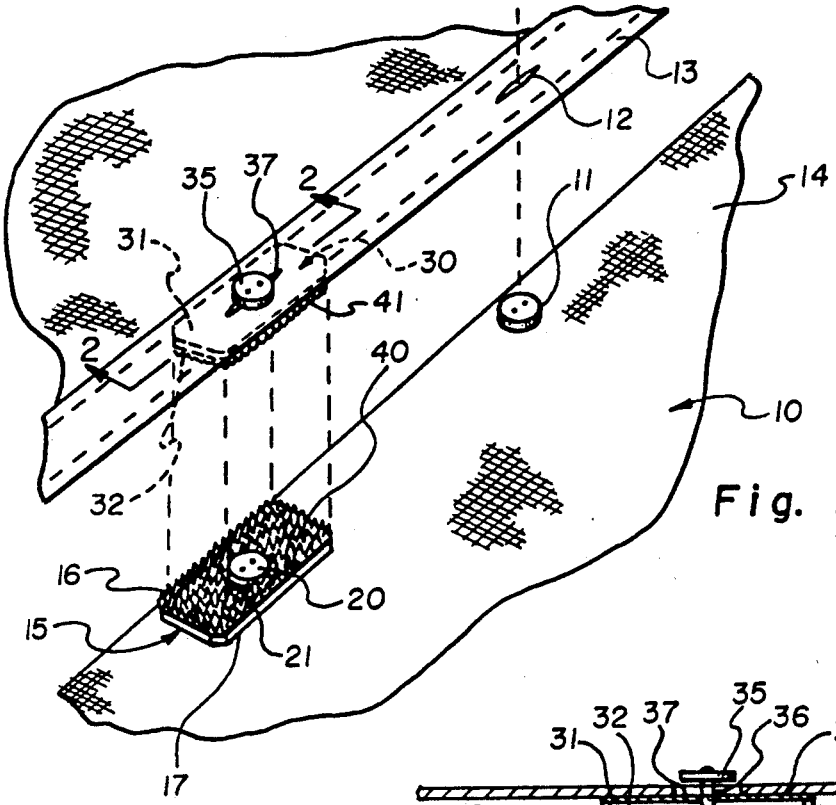
FIG. 1 shows a separated view of two pieces of fabric adapted with the device of the present invention.

FIG. 1 shows a section of shirt 10. A conventional button/button hole attachment hole combination is illustrated including a button 11 and button hole 12 existing in juxtaposed positions on respective first 13 and second 14 pieces of material to be temporarily joined together. This material may be conventional fabric, leather, plastic, or any other member of materials which are to be fastened in a temporary sense.

Figure 2:
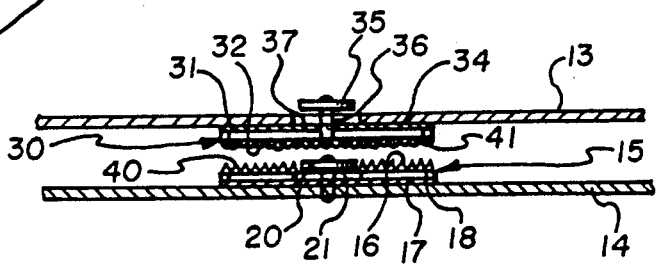
FIG. 2 represents a cross section taken along the lines 2—2 of FIG. 1 with the respective components of the invention in close proximity.

The difficulty of inserting the button 11 through button hole 12 is eliminated by the subject invention which is also shown in FIG. 1 and includes a VELCRO (TM) or hook/loop system which totally eliminates the need to insert a button through a button hole. This device comprises a first sheet of flexible material 15 which has an exposed side 16 and an attachment side 17. This first sheet of material 15 is also shown in FIG. 2, which further illustrates that the attachment side 17 includes attachment or adhesive means such as glue 18 for enabling permanent fixation of the first sheet 15 to the first piece of material 14. This first sheet of material 15 is positioned at a button location 19 which presumably existed prior to use of the present invention. For example, button 11 could also be adapted with the first sheet of material as disclosed above and which was applied with respect to button 20.

This first sheet of material may typically be made of a fabric or other substrate which is flexible, small and easily applied by way of glue 18 to the button location 20 of the shirt, blouse or other material. It will be noted by those skilled in the art that any substrate which operates in a manner similar to fabric could be substituted and could effectively meet the objectives of the present invention.

In the preferred embodiment, a button hole 21 is cut through the first sheet of material 15 to facilitate proper positioning of this component at the button location 20. A user simply positions the first sheet of flexible material 15 at the button location associated with the first piece of material comprising a shirt, blouse etc. The button 20 is inserted through this button hole 21, thereby providing proper orientation with respect to the shirt or blouse. With the button in place, an iron or other heating device is applied to the first sheet of material with the attached glue 17, which is activated by the heat and permanently affixes the first sheet of material 15 to the fabric 14. Numerous forms of heat or pressure sensitive glues are available and are well suited for application to this iron-on procedure. Accordingly, further explanation with respect to this aspect of the invention is unnecessary.

A second sheet of flexible material 30 also includes an attachment side 31 and an exposed side 32. These function in a manner similar to the respective exposed and attachment sides 16 and 17 of the first sheet of flexible material previously described. The attachment side 31 is similarly affixed to the second piece of material 13 by attachment or adhesive means 34. In the preferred embodiment, this adhesive would constitute a glue which is adhered to the material 13 in an iron-on format as previously described.

The attachment side 31 of the second piece of material 30 further includes a button 35 which is colored and configured similar to other buttons 11 already existing on the shirt, blouse or what is referred to generally herein as the first piece of material 14. This button may be sewed 36 to the second sheet of material 30 in a conventional manner. The purpose of this button 35 is to replace the original button 20 which will be concealed between the respective first and second sheets of flexible material during use.

This button 35 is utilized to properly orient the second sheet of material by applying the following steps. First, the second sheet of flexible material 30 is brought to proximity of the button hole 37 in overlapping configuration. Button 35 is then inserted through the button hole 37, providing a temporary coupling of the second sheet of material 30 to the second piece of fabric 13. When properly positioned, the second sheet of material is permanently fixed by a plug-in hot iron to the combination, sealing the glue 34 between the attachment side 31 and the fabric or second piece of material 13. This fabric 13 now has an appearance of being buttoned, based on an exposure of button 35 through the former button hole 37.

The present invention eliminates the need of repeatedly manipulating buttons through button holes by use of VELCRO (TM) material, or other hook/loop contact devices. Specifically, each exposed side 16 and 32 of respective first and second sheets of material includes a hook/loop attachment means 40 and 41 which operates to temporarily but securely engage in an earlock configuration upon contact. By applying separating force between the respective hook and loop faces 40 and 41, material can be pulled free without the need for dexterity by the user. Accordingly even persons with advanced nervous disorders or crippled hands and fingers may easily manipulate the present invention by simply bringing the exposed faces 16 and 32 in near contact to permit earlocking of the respective hook/-loop means 40 and 41. Similarly, the materials can be separated by applying a gentle pulling force between the respective pieces of material 13 and 14.

It includes the first sheet 15 coupled to the second sheet 30. The interconnecting hook and loop means 40 and 41 retain the two pieces together until the user is prepared to affix them at a shirt, blouse or other location of attachment. Button 35 is to be inserted through the button hole at the point of attachment to properly orient the second sheet of material 30. This package form provides convenience and all necessary components are retained together by means of the VELCRO (TM) material. When packaged in multiple sets, a variety of different colored buttons 35 may be enclosed in a single package, offering clear view to the user for appropriate selection to match buttons on the blouse or shirt to be modified.

Figure 4:
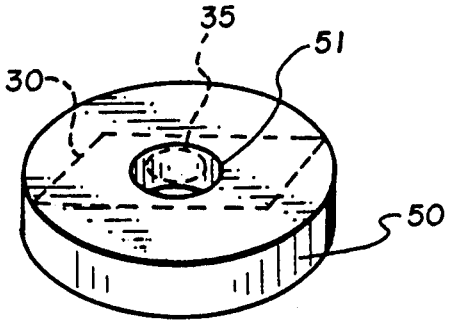
FIG. 4 illustrates a base member used to assist in applying the invention of FIG. 3 to a shirt or blouse.

FIG. 4 illustrates a base support 50 which is useful for the iron-on procedure. This comprises an annular body having an annular opening 51 which permits the button 35 to displace out of the way during application of the hot iron. Accordingly, the second sheet of material 30 is buttoned through the button hole on the shirt or blouse, temporarily securing its position. This portion of the attached second sheet of material and attached shirt or blouse is then laid across the support base 50 with the button oriented into the annular opening 51. An iron is then pressed on the blouse or shirt, activating the glue on the inventive device in securing it permanently in its appropriate position. This construction protects the button 35 and facilitates rapid emplacement using the iron-on process suggested. Typically, the support member 50 will be comprised of a heat resistant plastic or materials such as masonite or wood.

Figure 3:
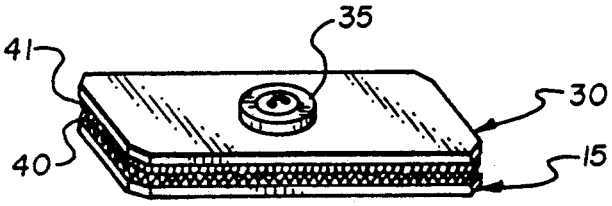
FIG. 3 shows a perspective view of the present invention in a package form.

A total conversion kit can be inserted in a small plastic bag in which several of the assembled components as shown in FIG. 3 are included with a support base as shown in FIG. 4. This total kit occupies very little space and can be conveniently marketed.

It will be apparent to those skilled in the art that the represented examples are primarily for purposes of illustration. Accordingly, the following claims are not to be limited by the use of such specific examples.

We claim:

1. A device for converting a button/button hole attachment combination existing in juxtaposed positions on respective first and second pieces of material to be temporarily joined together to a pressure contact system, said device comprising:

1. a first sheet of flexible material having an exposed side and an attachment side, said attachment side including attachment means for enabling permanent fixation of the first sheet to the first piece of material to be joined in an overlapping position with a button location of the first piece of material;
2. a second sheet of flexible material having an exposed side and an attachment side, said attachment side including attachment means for enabling permanent fixation of the second sheet to the second piece of material to be joined in overlapping configuration with a button hole located in the second piece of material;
3. at least one button coupled to the attachment side of the second sheet, said button coupled to the attachment side of the second sheet, said button being configured and colored to complement other buttons on the second piece of material;
4. the respective exposed sides of the first and second sheets of material including hook/loop attachment means capable of being joined on contact and separated by merely pulling the respective pieces of material apart; and said first sheet of material further includes a button hole configured in size to receive a button of the button/button hole combination, thereby facilitating proper positioning of the first sheet of flexible material by inserting the button of the button/button hole combination through the button hole of the first sheet of material to correctly align the first sheet of material with the second sheet of material which is to be positioned on the second piece of material by inserting the button coupled to the second sheet of material through the button hole of the second piece of fabric.

2. A device as defined in claim 1, wherein the first and second sheet of flexible material comprise fabric.

3. A device as defined in claim 2, wherein the attachment means comprise adhesive means comprises a glue which is activated by heat such as is generated by an iron applied to the fabric material.

4. A method of converting a button/button attachment combination existing in juxtaposed positions on respective first and second pieces of material to be temporarily joined together to a pressure contact attachment device to facilitate temporary attachment of the two pieces of material; said method comprising the steps of:

1. positioning a first sheet of flexible material having an exposed side and an attachment side at the first piece of material to be joined at an overlapping position with a button location on the first piece of material;
2. permanently affixing the first sheet of material at the overlapping position with attachment means;
3. positioning a second sheet of flexible material having an exposed side and an attachment side at the second piece of material to be joined in overlapping configuration with a button hole located in the second piece of material;
4. inserting a button coupled to the attachment side of the second sheet through the button hole in the second piece of material to thereby position the second sheet in proper alignment with the first sheet of material applied to the button location of the first piece of material;
5. permanently affixing the second sheet of material at the aligned position on the second piece of material with attachment means;
6. permanently applying respective components of a hook/loop attachment means to the respective exposed faces of the first and second sheets of flexible material;
7. contacting the respective exposed sides of the first and second sheets of material with their attached hook/loop attachment means to temporarily attach the two pieces of material.

5. A method as defined in claim 4, wherein step 1 comprises the more specific steps of:

1. forming a button hole in the first sheet of material in a size compatible to receive a button attached to the first piece of material at the button location; and
2. positioning the first sheet of flexible material at the first piece of material to be joined at the overlapping position with the button location; and
3. inserting the button at the button location through the button hole on the first sheet of flexible material.

6. A method as defined in claim 4, wherein the respective steps of 2 or 5 for permanently affixing the first and second sheets of material comprise applying heat from an iron to activate attachment adhesive coatings on the attachment sides to bond to the first and second pieces of material.

* * * * *